US005409133A

United States Patent [19]

Gringer

[11] Patent Number: 5,409,133

[45] Date of Patent: Apr. 25, 1995

[54] RAZOR BLADE DISPENSER

[75] Inventor: Donald Gringer, New York, N.Y.

[73] Assignee: Allway Tools, Inc., Bronx, N.Y.

[21] Appl. No.: 198,980

[22] Filed: Feb. 17, 1994

[51] Int. Cl.[6] ..... B65D 83/00

[52] U.S. Cl. ..... 221/102; 221/279; 221/307; 206/357; 206/360

[58] Field of Search ..... 221/102, 279, 307, 310; 206/39.5, 39, 355, 357, 359, 360

[56] References Cited

U.S. PATENT DOCUMENTS

| | | | |
|---|---|---|---|
| D. 224,290 | 7/1972 | Robertson . | |
| 1,908,115 | 5/1933 | Chadwick | 206/360 |
| 2,574,568 | 11/1951 | Jolie | 221/307 |
| 2,641,358 | 6/1953 | Santo . | |
| 2,928,531 | 3/1960 | Henley | 221/279 |
| 3,180,484 | 4/1965 | Kuhnl | 206/360 |
| 3,219,244 | 11/1965 | Blask | 221/310 |
| 3,543,918 | 12/1970 | Waterman | 221/102 |
| 3,567,071 | 3/1971 | Benson . | |
| 3,604,562 | 9/1971 | Loeffler . | |
| 3,650,433 | 3/1972 | Robertson . | |
| 3,696,915 | 10/1972 | Douglas . | |
| 3,710,929 | 1/1973 | Morales | 206/39.5 |
| 3,760,938 | 9/1973 | Ferrier, Jr. . | |
| 3,764,040 | 10/1973 | Solomon . | |
| 3,767,083 | 10/1973 | Webb . | |
| 3,774,805 | 11/1973 | Baker et al. . | |
| 3,783,493 | 1/1974 | Dawidowicz et al. . | |
| 3,785,051 | 1/1974 | Dawidowicz et al. . | |
| 3,827,597 | 8/1974 | Braginetz . | |
| 3,834,018 | 9/1974 | Dawidowicz et al. . | |
| 3,854,201 | 12/1974 | Dawidowicz et al. . | |
| 3,869,066 | 3/1975 | Ferraro . | |
| 3,910,455 | 10/1975 | Ferraro . | |
| 3,941,244 | 3/1976 | Braginetz . | |
| 4,043,035 | 8/1977 | Pentney . | |
| 4,047,295 | 9/1977 | Francis . | |
| 4,073,407 | 2/1978 | Pentney . | |
| 4,090,638 | 5/1978 | Pentney . | |
| 4,122,983 | 10/1978 | Jolly . | |
| 4,228,587 | 10/1980 | Bennett . | |
| 4,373,646 | 2/1983 | MacEwen . | |
| 4,379,514 | 4/1983 | Joffe . | |
| 4,432,473 | 2/1984 | MacEwen . | |
| 4,483,068 | 11/1984 | Clifford . | |
| 4,700,600 | 10/1987 | Pickett . | |
| 4,776,091 | 10/1988 | Yakou . | |
| 4,787,543 | 11/1988 | Fabo et al. . | |
| 4,789,080 | 12/1988 | Iten . | |
| 4,791,723 | 12/1988 | Jacobson . | |
| 4,792,058 | 12/1988 | Parker . | |
| 4,826,042 | 5/1989 | Vujovich . | |
| 4,908,945 | 3/1990 | Jacobson . | |
| 4,916,814 | 4/1990 | Althaus . | |
| 4,978,031 | 12/1990 | Lembke . | |
| 4,998,647 | 3/1991 | Sharp . | |
| 5,005,288 | 4/1991 | Wilk . | |
| 5,044,525 | 9/1991 | McKinney . | |
| 5,070,611 | 12/1991 | Derin et al. . | |
| 5,103,560 | 4/1992 | Podalsky . | |
| 5,131,564 | 7/1992 | Plonkey . | |
| 5,134,775 | 8/1992 | Althaus et al. . | |
| 5,251,783 | 10/1993 | Gringer . | |
| 5,265,759 | 11/1993 | Coffin . | |

FOREIGN PATENT DOCUMENTS

| | | | |
|---|---|---|---|
| 0839403 | 5/1952 | Germany | 221/102 |

*Primary Examiner*—H. Grant Skaggs
*Attorney, Agent, or Firm*—David M. Klein; Bryan Cave

[57] ABSTRACT

An apparatus for storing a plurality of razor blades and for dispensing the razor blades is disclosed. The dispenser includes a housing having side and end walls which define a cavity for storing and dispensing razor blades. The open top of the dispenser includes rails along the tops of the sidewalls for guiding the blades out of the housing. A dispensing slot is provided between the top of one end wall and the rails. A resilient arm integral with the housing is located below the razor blades for applying an upward force on the razor blades against the rails and for aligning a blade to be dispensed with the dispensing slot. The entire dispenser is molded of a thermoplastic. A disposal slot is vertically aligned with the radiused end of the resilient arm for enabling disposal of used razor blades.

8 Claims, 5 Drawing Sheets

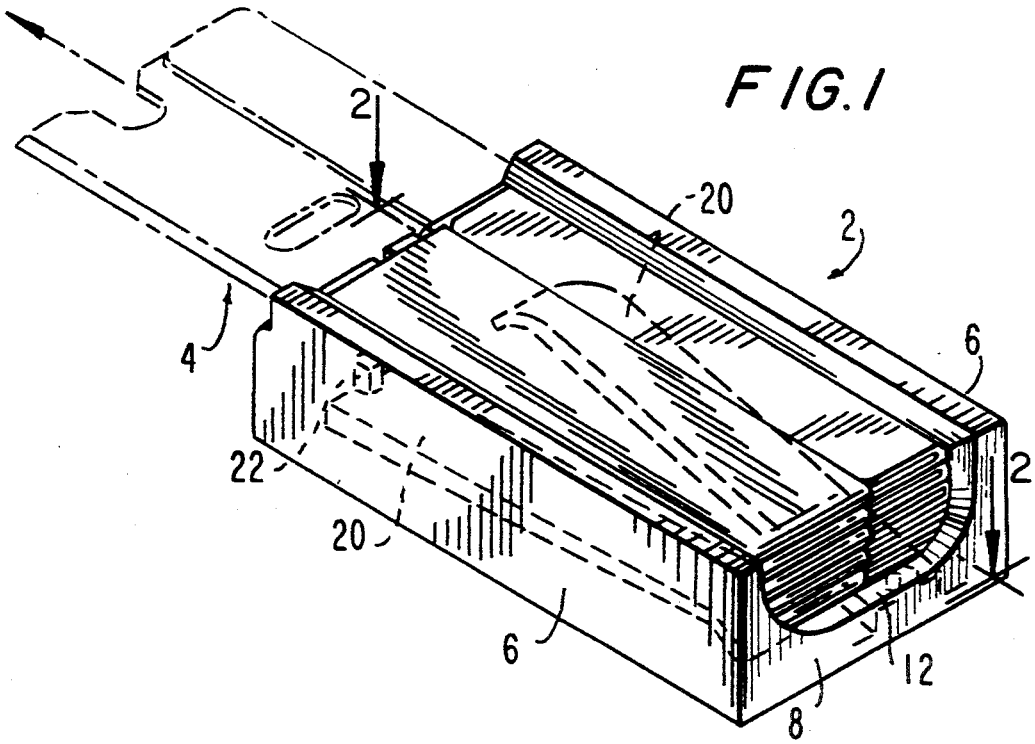
FIG. 1
FIG. 2
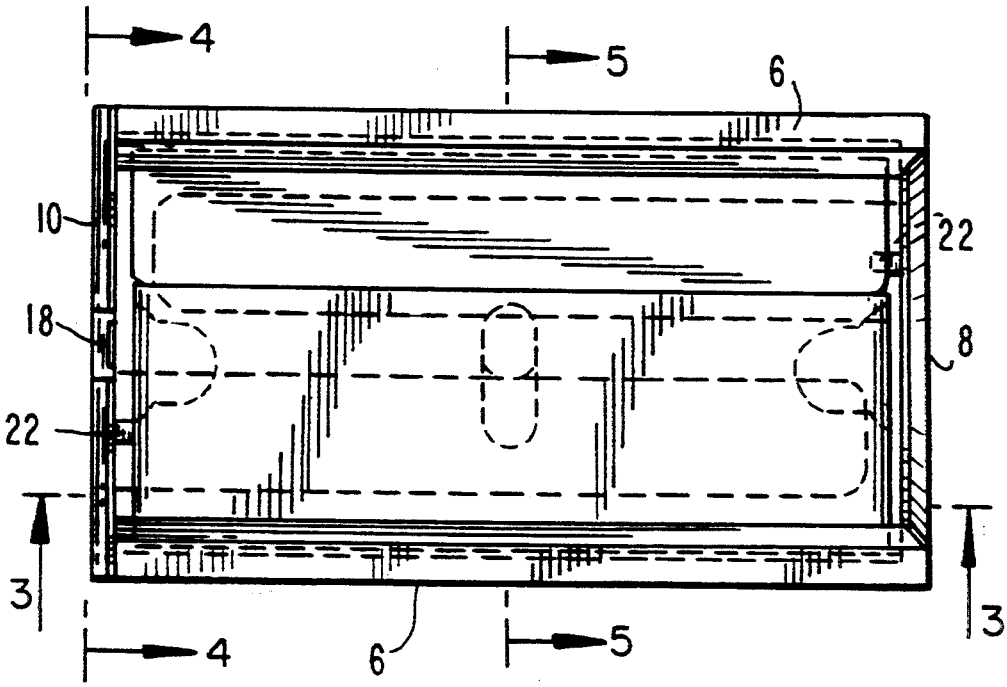

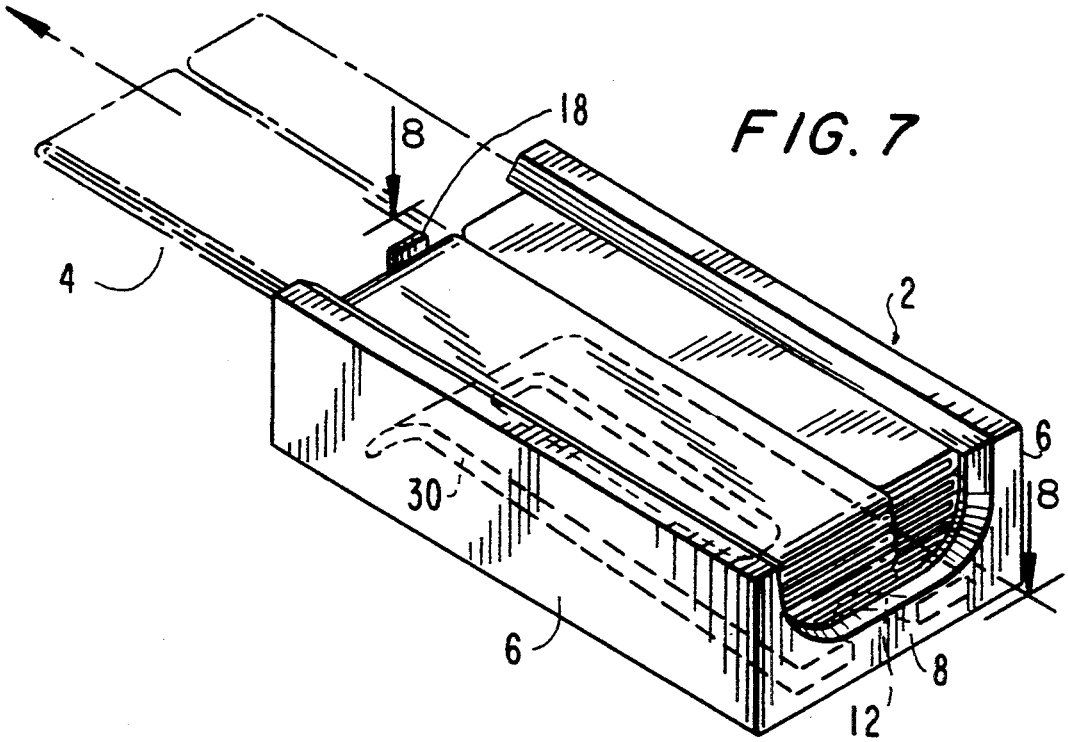
FIG. 7
FIG. 8
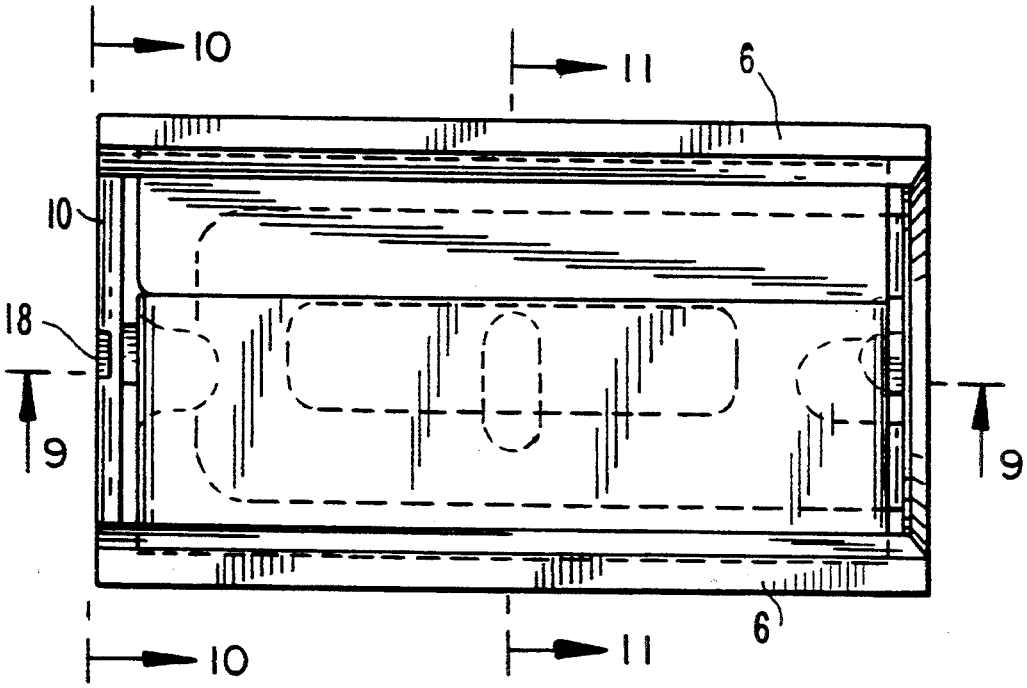

RAZOR BLADE DISPENSER

BACKGROUND OF THE INVENTION

1. Field of the Invention

The present invention relates to razor blade holders and dispensers and more particularly to a razor blade holder and dispenser which includes a resilient cantilever for positioning the blades in alignment with a dispensing slot and which may be molded as a one-piece dispenser.

2. Description of the Prior Art

Typically, razor blades are sold to consumers in five-pack cardboard packaging or ten-pack dispensers that are made of multiple parts. To protect the consumer, each blade in the cardboard box is wrapped in an individual paper shell. When a blade is to be used, the package is opened and the blade removed. Blades currently available in dispensers are unshelled which exposes the dangerous edge of the blade as it is dispensed. Other types of five and ten-pack dispensers are made of two-piece plastic boxes with a separate metal leaf spring.

Obviously, it would be advantageous to sell such blades in a simple, inexpensive dispenser which would enable the blades to be slid from the dispenser when needed, with a protective wrap if desired. It would also be desirable if such a dispenser provided means for disposing of razor blades after use. In order to be commercially viable, such a dispenser must be lightweight, easy to use, and inexpensive to produce.

Several types of razor blade dispensers are shown in the prior art. Commonly owned U.S. Pat. No. 5,251,783 discloses a utility blade dispenser in which the blades are loaded into a housing on a movable blade carrier. Blades are dispensed through a dispensing slot by means of a finger guide slot. A disposal chamber is formed in the dispenser as new blades are removed and the blade carrier is moved upward. Other dispensers of this type are shown for example in U.S. Pat. Nos. 3,650,433, 4,379,514, 4,789,080, 4,826,042 and D224,290.

Dispensers of this type are not practical for prepackaging small numbers of blades. They are too expensive, too large, and too complicated to be economical to manufacture.

Santo, U.S. Pat. No. 2,641,358 discloses a razor blade dispenser having a compartment for insertion of used blades. A spring is inserted between the bottom of the housing and the blades to push the blades upwardly into alignment with a dispensing slot. Mechanical means is provided for pushing the blades from the dispenser. Used blades are pushed into the housing under the spring through a disposal slot.

This type of dispenser contains numerous loose or moving parts, which increases the cost of the device, and also makes manufacture of the device more complicated. Given the low cost of razor blades, such a device would substantially drive up the cost of selling preloaded blades as compared to conventional cardboard packaging.

Accordingly, it is an object of the present invention to provide a razor blade dispenser which may be inexpensively manufactured and thus serve as a cost-effective replacement for conventional cardboard packaging for razor blades. It is a further object to provide such a dispenser with no loose parts, and which includes a blade disposal chamber.

SUMMARY OF THE INVENTION

The present invention is an apparatus for storing a plurality of razor blades and for dispensing the razor blades. The blade dispenser may be manufactured in a cost-effective manner to allow new razor blades to be packaged and sold in the dispenser. The dispenser comprises a housing having side and end walls which define a cavity sized and shaped for enabling the razor blades to be stacked therein. The top of the dispenser is open except that each of the side walls includes a rail running lengthwise along its top with each rail extending inwardly over a portion of the top of the housing. The rails prevent the razor blades in the housing from falling out the top of the housing and enable a user to guide the top razor blade out of the housing with a finger.

A dispensing slot is provided between the top of one end wall and the rails. One or more resilient arms integral with the housing is located below the razor blades for applying an upward force on the razor blades against the rails and for aligning a blade to be dispensed with the dispensing slot. The entire one-piece dispenser may be manufactured in one step using an injection molded thermoplastic. No loose parts are required to operate the dispenser, except the blades themselves.

The end wall opposed to the dispensing slot may include a finger cutout for guiding the razor blades through the dispensing slot. A resilient tongue is located in the dispensing slot to prevent razor blades from falling out of the dispenser unless pressure is applied on the blade against the resilient tongue.

If desired, two resilient arms may be used, each of the resilient arms having a first end integral with the dispenser housing and a second end in contact with a bottom razor blade. The resilient arms may be oriented in the same direction or opposite directions. Regardless of the number of resilient arms used, the end of each resilient arm in contact with the blades is preferably radiused.

In one embodiment, razor blades may be disposed of in the dispenser. A horizontal disposal slot is vertically aligned with the radiused end of the resilient arm for enabling used razor blades to be inserted through the disposal slot between the resilient arm and a bottom razor blade for disposing the used blades.

BRIEF DESCRIPTION OF THE DRAWINGS

FIG. 1 is a perspective view of the razor blade holder and dispenser of the present invention.

FIG. 2 is a cross-sectional view of the razor blade holder and dispenser of the present invention through section 2—2.

FIG. 7 is a perspective view of an alternative embodiment of the of the present invention.

FIG. 8 is a cross-sectional view of the razor blade holder and dispenser shown in FIG. 7 through Section 8—8.

DESCRIPTION OF THE PREFERRED EMBODIMENT

Figure 3:
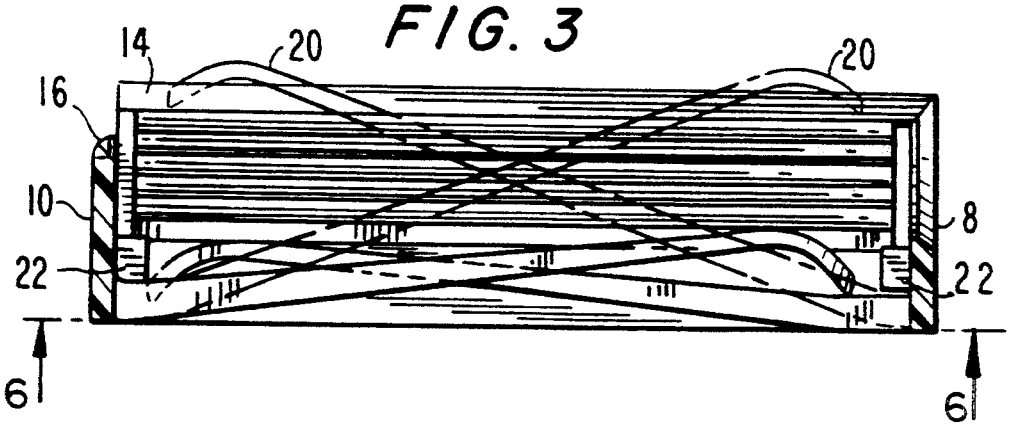
FIG. 3 is a cross-sectional view of the razor blade holder and dispenser of the present invention through section 3—3 showing two resilient lift springs and a slot for used blades.

As shown in FIGS. 1–6, the present invention is a dispenser 2 for razor blades 4 and the like. The dispenser 2, includes a generally rectangular shaped housing adapted for having razor blades 4 inserted therein and dispensed therefrom. Dispenser 2 is relatively light in weight and small in size and may be inexpensively manufactured for enabling razor blades to be sold inserted in the dispenser 2 in a paper shelling.

The dispenser includes side walls 6 and end walls 8 and 10 which define a rectangular cavity from which the razor blades are dispensed. Obviously, the shape of the cavity may be changed for dispensing non-rectangular blades. The bottom of dispenser 2 is preferably open, but may be closed if desired. End wall 8 has a finger cutout defined between the top of the end wall and rails 14 which enables a user to dispense the blades 4 by sliding a razor blade 4 from dispenser 2 with their finger. Each sidewall 6 includes a rail 14 which prevents razor blades 4 in the dispenser 2 from falling out of the top of the dispenser 2 and for guiding razor blades 4 out of the dispenser.

Figure 4:
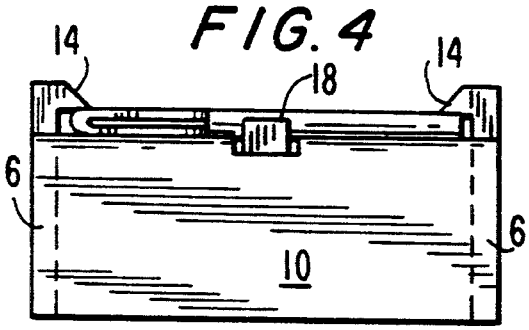
FIG. 4 is an end view of the razor blade holder and dispenser of the present invention.
Figure 5:
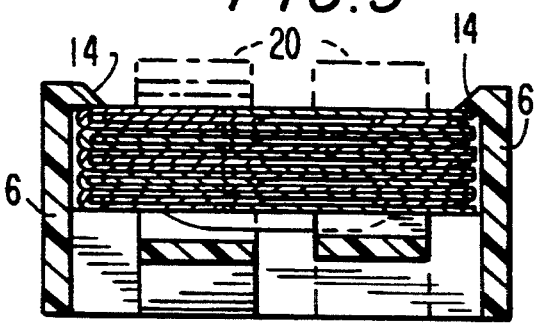
FIG. 5 is cross-sectional view of the razor blade holder and dispenser of the present invention through section 5—5.
Figure 6:
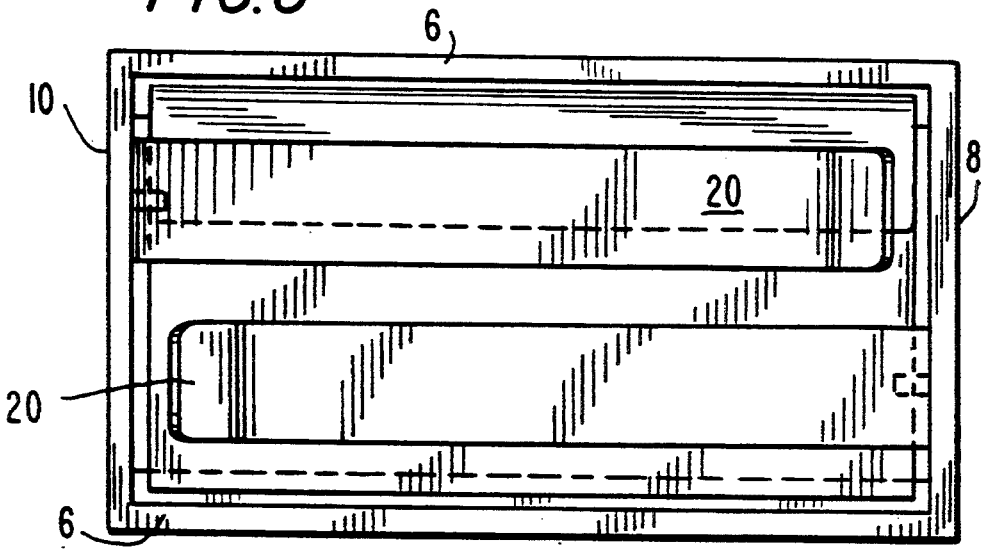
FIG. 6 is a bottom view of the razor blade holder and dispenser of the present invention.

As shown in FIG. 4, a dispensing slot in end wall 10 having a height S defined between the top 16 of end wall 10 and rails 14 is provided. The height S is preferably sized to enable one razor blade to freely slide out of the dispenser 2 between the top 16 of end wall 10 and the rails 14. The height S is not large enough to enable more than one blade to slide through the opening at one time. A resilient tongue or lip 18 prevents razor blades 4 from sliding out of the dispenser 2 unless sufficient lateral force is applied to a blade 4 to bend the tongue 18. Once a blade 4 has been removed from the dispenser 2, resilient tongue 18 preferably snaps back into position for preventing blades 4 from falling out of the dispenser 2. If desired, the resilient lip 18 may be replaced by a spring loaded check to keep the loose blades from falling out of the dispenser 2.

In order to maintain an upward force on the blades 4 in the dispenser 2, a pair of resilient arms 20 is provided. Each of the resilient arms 20 is preferably integral with the dispenser 2 structure. This enables the present invention to be inexpensively constructed by molding of a thermoplastic. Each of the arms 20 provides sufficient resilience whereby the dispenser 2 may be pre-loaded with a number of razor blades sufficient to fill dispenser, preferably five, and the arms 20 will retain sufficient upward force to press the blades 4 against rails 14 as each blade is removed. The resilient arms 20, and the entire dispenser structure, are preferably made of an acetal resin or any hard resilient thermoplastic. The blades 4 are kept slightly imbalanced upward toward the disposal slot to prevent the blades from falling from the dispensing slot and to place them in position so that the top blade may be easily dispensed. Each of the resilient arms 20 is actually a cantilevered spring which is preferably thicker at the bottom to enable the stress on the spring to be distributed and to spread the load on the spring throughout its length. When manufactured, the spring preferably extends upward past the top of the chamber so that the spring will be pre-loaded and provide adequate resilience when only one or a few blades are left in the dispenser. Spacers 22 may be provided for preventing the resilient arms from being overly extended when the dispenser 2 is loaded with blades 4. The ends of resilient arms 20 are preferably radiused or curved to provide a larger surface area for the contact point between the resilient arms 20 and blades 4.

FIGS. 7–12 show an alternative embodiment of the invention. The dispenser 2 is similar to the previous embodiment in that it includes sidewall 6, end wall 8 having a finger sliding channel, and rails 14 for guiding the razors 4 being dispensed from the dispenser 2. This embodiment of the invention is suitable for dispensing new razor blades, and for loading used razor blades back into the dispenser for disposal. Toward this end, a dispensing slot is provided defining a dispensing opening between rails 14 and cross bar 32. Resilient tongue 18 prevents the blades 4 from falling out of the dispenser. A disposal opening 34 is defined between end wall 10 and cross bar 32. Disposal opening 34 is sized for enabling a blade to be passed therethrough. It is foreseen that the used blade disposal slot 34 could be located on either end 8 or 10 of the dispenser 2.

Figure 9:
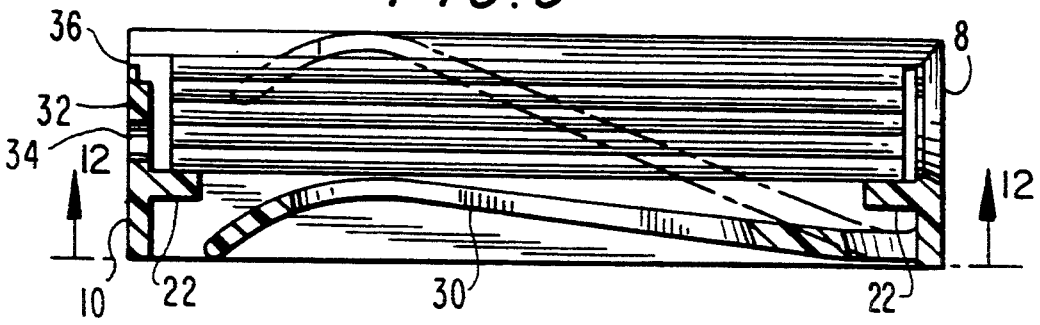
FIG. 9 is a cross-sectional view of the embodiment of the present invention shown in FIG. 7 through Section 9—9.
Figure 10:
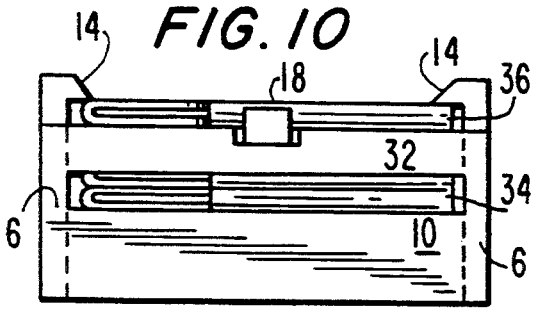
FIG. 10 is an end view with an embodiment of the present invention shown in FIG. 7.
Figure 11:
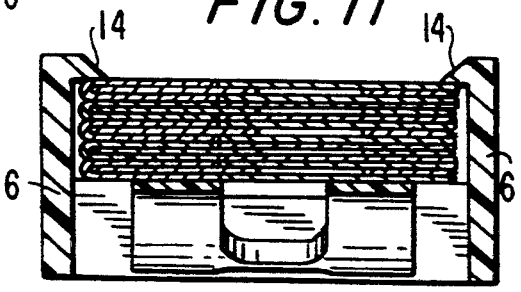
FIG. 11 is a cross-sectional view of the embodiment of the present invention shown in FIG. 7 through Section 11—11.
Figure 12:
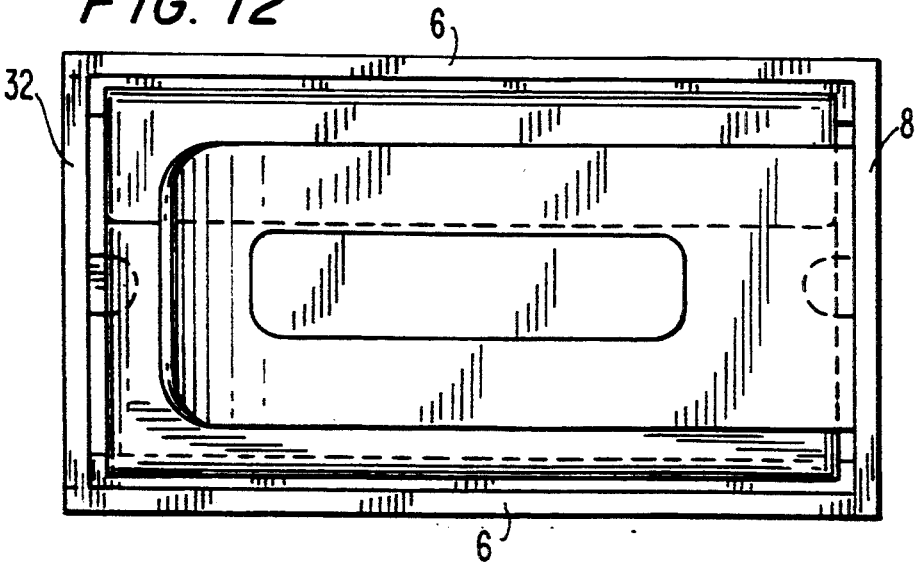
FIG. 12 is a bottom view of the embodiment of the present invention shown in FIG. 7.

If the disposal feature of this embodiment is not used, as each blade 4 is removed from the dispenser, resilient arm 30 will maintain an upward force upon the remaining blades, until no blades are left and the resilient arm is at its full unbiased position as shown in shadow in FIG. 9. The end of resilient arm 30 is radiused to allow removal and insertion of blades 4 as shown at A in FIG. 9. When a blade 4 is removed from the dispenser through opening 36, resilient arm A will move upward slightly to maintain pressure upon the remaining blades. When that blade is to be disposed of, it is inserted through disposal slot 34 which is aligned with the radiused portion of the resilient arm 30. The used blade contacts end portion A of resilient arm 30 forcing it downward and enabling the used blade to be inserted below the bottom blade.

Figure 13:
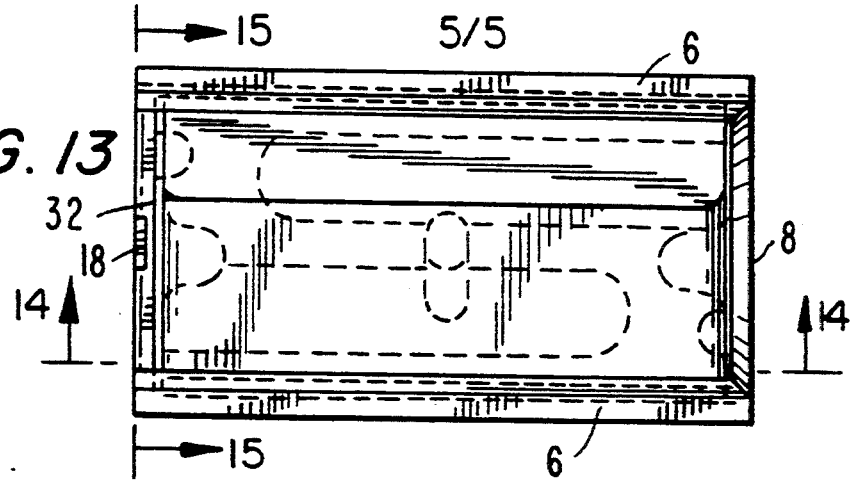
FIG. 13 is a top view of an alternative embodiment of the present invention.
Figure 14:
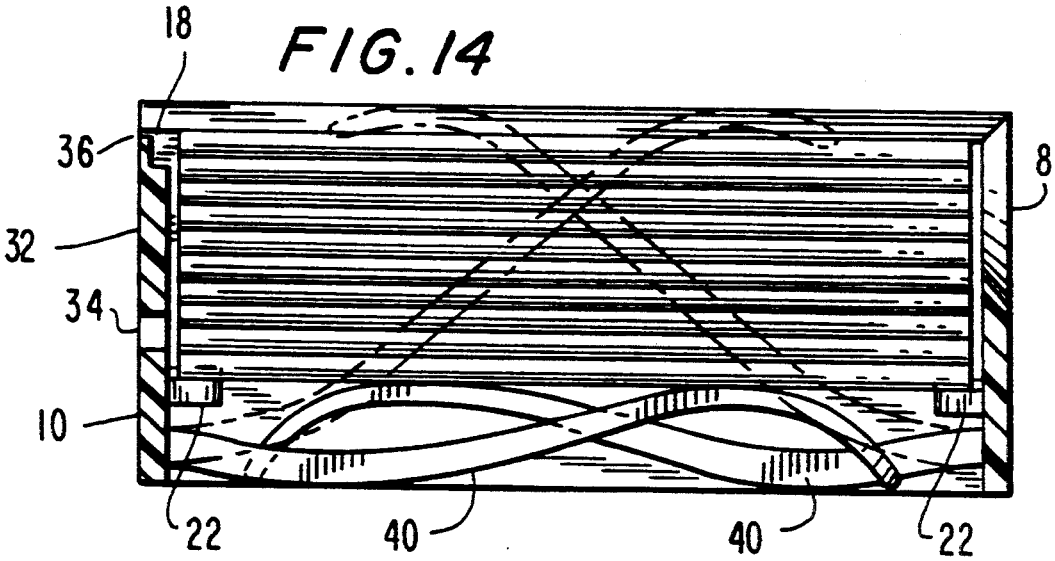
FIG. 14 is a cross-sectional view of the embodiment of the invention shown in FIG. 13 through Section 14—14.
Figure 15:
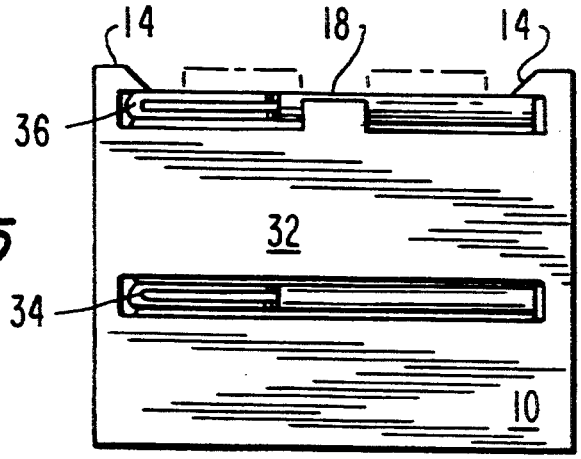
FIG. 15 is an end view of the embodiment of the present invention shown in FIG. 13.

FIGS. 13–15 show an alternative embodiment of the present invention in which a greater number of blades, preferably ten blades, may be pre-loaded and dispensed through slot 36 and disposed of through slot 34. Each of the resilient arms 40 is substantially similar to those described with respect to the first embodiment.

Although the present invention has been described in detail with respect to certain embodiments and examples, variations and modifications exist which are within the scope of the present invention as defined in the following claims for example, the present dispenser design should not be limited to dispensing single edged razor blades. Depending on the shape of the dispenser, it may be used to dispense double edged blades, trapezoidal utility blades, long break off and scraping blades as well as any flat rectangular object, such as chewing gum sticks.

I claim:

1. An apparatus for storing a plurality of razor blades and for dispensing the razor blades, the apparatus comprising:

a dispenser housing comprising a pair of side walls and a pair of end walls defining a cavity in the housing, the cavity sized and shaped for enabling the razor blades to be stacked therein, the dispenser having an open top, each of the side walls comprising a rail running lengthwise along the top of the side wall, each rail extending inwardly over a portion of the top of the housing for preventing the razor blades in the housing from moving through the top of the housing, and a dispensing slot defined between the top of the first end wall and the rails for enabling a razor blade in the housing to be dispensed from the housing through the dispensing slot guided by the rails; and a pair of resilient arms disposed in the housing below the razor blades, each resilient arm having a first end integral with the dispenser housing, and a second end in contact with a bottom razor blade for applying an upward force on the razor blades against the rails and for aligning a blade to be dispensed with the dispensing slot, the first end of each resilient arm being integral with the dispenser housing adjacent opposite end walls of the dispenser housing.

2. The apparatus according to claim 1 wherein the housing and resilient arms comprise a molded thermoplastic.

3. The apparatus according to claim 1 wherein the second end wall comprises a finger cutout for facilitating the use of a finger for guiding the razor blades through the dispensing slot.

4. The apparatus according to claim 3 further comprising a resilient lip disposed in the dispensing slot for preventing the razor blades from falling out of the dispenser unless pressure is applied on the blade against the resilient tongue.

5. The apparatus according to claim 1 further comprising a resilient tongue disposed in the dispensing slot for preventing the razor blades from falling out of the dispenser unless pressure is applied on the blade against the resilient tongue.

6. The apparatus according to claim 1 wherein a height of the dispensing slot is sized to enable no more than one razor blade to pass through the slot at one time.

7. The apparatus according to claim 1 wherein the second end of the resilient arm is radiused.

8. The apparatus according to claim 1 wherein the second end of each resilient arm is radiused; and one end wall of the housing further comprises a horizontal disposal slot vertically aligned with the radiused end of one resilient arm and vertically above the first end of the other resilient arm for enabling used razor blades to be inserted through the disposal slot between the resilient arms and a bottom razor blade disposing the used blades.

* * * * *

UNITED STATES PATENT AND TRADEMARK OFFICE

CERTIFICATE OF CORRECTION

PATENT NO. : 5,409,133

DATED : April 25, 1995

INVENTOR(S): Donald Gringer

It is certified that error appears in the above-identified patent and that said Letters Patent is hereby corrected as shown below:

Column 6, line 9: Delete "lip" insert –tongue–.

Signed and Sealed this

Twentieth Day of June, 1995

Bruce Lehman

*Attest:*

BRUCE LEHMAN

*Attesting Officer*

*Commissioner of Patents and Trademarks*